US005241926A

United States Patent [19]

Sato et al.

[11] Patent Number: 5,241,926

[45] Date of Patent: Sep. 7, 1993

[54] ENGINE COOLING APPARATUS

[75] Inventors: Masaaki Sato; Naoki Nagano; Hidesaku Ebesu; Toshimichi Akagi, all of Hiroshima, Japan

[73] Assignee: Mazda Motor Corporation, Hiroshima, Japan

[21] Appl. No.: 925,778

[22] Filed: Aug. 7, 1992

[30] Foreign Application Priority Data

Aug. 9, 1991 [JP] Japan ..... 3-225051
Sep. 25, 1991 [JP] Japan ..... 3-246178

[51] Int. Cl.[5] ..... F01P 3/22
[52] U.S. Cl. ..... 123/41.54; 123/41.29
[58] Field of Search ..... 123/41.29, 41.54, 563; 165/41; 180/68.1, 68.4, 68.6

[56] References Cited

U.S. PATENT DOCUMENTS 2,147,993 2/1939 Scheibe ..... 123/41.54
3,139,073 6/1964 White et al. ..... 123/41.54
4,352,342 10/1982 Cser et al. ..... 123/41.54
4,913,107 4/1990 Schweiger ..... 123/41.54
5,111,776 5/1992 Matsushiro et al. ..... 123/41.54

FOREIGN PATENT DOCUMENTS 62-87606 4/1979 Japan .
55-146824 4/1987 Japan .

*Primary Examiner*—Noah P. Kamen

[57] ABSTRACT

An engine cooling apparatus capable of assuring an adequate air-water separating function in an arrangement wherein an air-water separating tank having a pressure valve is provided at a point along a coolant passageway. The apparatus has a closed circulating system constructed from an engine, a radiator and a coolant passageway connecting the engine and radiator, wherein, a coolant for cooling the engine is made to circulate in the closed circulating system from upstream to downstream, and air which mixes with the coolant is discharged outside the closed circulating system. The apparatus includes a branch passageway which branches off from a first intermediate portion of the coolant passageway and merges with the coolant passageway at a second intermediate portion thereof that is downstream of the first intermediate portion, and an air-water separating tank arranged in an intermediate portion of the branch passageway and having a pressure valve which opens to the atmosphere at a prescribed pressure in order to discharge the air to the outside of the closed circulating system.

10 Claims, 9 Drawing Sheets

ENGINE COOLING APPARATUS

BACKGROUND OF THE INVENTION

This invention relates to a cooling apparatus for engines and, more particularly, to an engine cooling apparatus having an improved air-water separating function. Further, the invention relates to an engine cooling apparatus placed in juxtaposition with an intercooler provided in order to cool the intake air to the engine combustion chamber.

An arrangement well known in the art as an apparatus for cooling automobile engines generally is so adapted that the engine and radiator of the automobile are connected via a coolant passageway through which cooling water is circulated. When a large quantity of air mixes in with the cooling water as the engine runs, oxidation of a coolant such as a rust-preventing agent mixed together with the cooling water in advance, overheating and cavitation occur much sooner. This makes it necessary to separate the air that mixes in with the coolant and discharge the air to the outside of the cooling flow path.

As an expedient for providing a function for separating air from cooling water (which function shall be referred to as an "air-water separating function" hereinafter), it is well known to furnish a pressure valve provided on a radiator cap at the top of the radiator, which radiator is installed so as to be substantially perpendicular to the ground. In this well-known example, the air mixing in with the cooling water is separated via the pressure valve, after which the air is collected in a reservoir tank.

In vehicles in which the radiator is tilted forward in order to reduce the area of the forward projection of the vehicle body, the pressure valve cannot be provided on the radiator cap located on the top of the radiator in the manner mentioned above. Accordingly, an air-water separating tank having a pressure valve is installed at a point along the passageway of the cooling water, and the tank serves to separate the air from the water. For example, the specification of Japanese Utility Model Application Laid-Open (KOKAI) No. 55-146824 discloses a technique in which the cooling water of the engine is cooled by a radiator and air is removed from the cooling water by the air-water separating tank, whereby cooling efficiency of the engine is improved.

In the above-described arrangement wherein the pressure valve is provided on the top of the radiator, some of the cooling water flows out into the reservoir tank along with the air via the pressure valve and is discharged to the outside.

In the other arrangement wherein the air-water separating tank is provided in series with the passageway of the cooling water, the amount of cooling water which flows into the air-water separating tank is approximately the same as that which flows into the radiator, and therefore the air-water separating tank is designed to have a large capacity.

In the latest high-performance automobiles, the intake air of the engine is compressed by a turbo-supercharger and the compressed intake air is passed through an intercooler so as to be cooled, thereby increasing the amount of intake air fed into the combustion chamber. To accomplish this, the intercooler is so adapted that an upper tank into which the intake air flows and a lower tank which feeds the intake air into the engine are connected by a number of pipes, the outer peripheral surface of each of which is provided with innumerable fixed cooling fins so that the intake air passing through the pipes will be cooled by the wind produced as the vehicle travels.

In the intercooler thus constructed, the wind introduced to the interior of the engine room from an opening in the front of the vehicle body is made to blow against the intercooler in a positive fashion in order to enhance the effect of cooling upon the intake air passing through the pipes.

In the arrangement in which the air-water separating tank is provided in series with the passageway of the cooling water, a problem is encountered wherein the air-water separating tank must have a large capacity, as mentioned earlier. If it is attempted to reduce the capacity in order to make the air-water separating tank more compact, the air-water separating function is rendered inadequate and some of the cooling water flows into the reservoir tank along with the air. This leads to insufficiency in terms of the circulating cooling water and to risk of overheating. Furthermore, since the intercooler is constructed as set forth above, it does not possess sufficient rigidity to the strong wind caused by the traveling vehicle. When the air impacts strongly against the intercooler, the intercooler core provided with the cooling fins vibrates and produces noise, and there is the danger that the intercooler will be damaged.

SUMMARY OF THE INVENTION

Accordingly, a first object of the present invention is to provide an engine cooling apparatus capable of assuring an adequate air-water separating function in an arrangement wherein an air-water separating tank having a pressure valve is provided at a point along a coolant passageway.

A second object of the present invention is to provide an engine cooling apparatus in which an air-water separating tank can be reduced in size and made more compact.

A third object of the present invention is to provide an engine cooling apparatus in which, when the apparatus is placed in juxtaposition with an intercooler, the radiator and the intercooler can be maintained at an optimum temperature and vibration of the intercooler core can be prevented.

According to the present invention, the foregoing objects are attained by providing an engine cooling apparatus in which a closed circulating system is constructed from an engine, a radiator and a coolant passageway, a coolant for cooling the engine is made to circulate in the closed circulating system from upstream to downstream, and air which mixes with the coolant is discharged outside the closed circulating system, the apparatus comprising a branch passageway which branches off from a first intermediate portion of the coolant passageway and merges with the coolant passageway at a second intermediate portion thereof that is downstream of the first intermediate portion, and an air-water separating tank arranged in an intermediate portion of the branch passageway and having a pressure valve which opens to the atmosphere at a prescribed pressure in order to discharge the air to the outside of the closed circulating system.

In another preferred embodiment of the invention, there is provided an engine cooling apparatus in which a closed circulating system is constructed from an engine, a radiator and a coolant passageway, a coolant for cooling the engine is made to circulate in the closed circulating system from upstream to downstream, and air which mixes with the coolant is discharged outside the closed circulating system, the apparatus comprising a pump for circulating the coolant from upstream to downstream, a bypass passageway in which a thermostat having a three-way branching flow path is connected between a discharge side of the engine and an inlet side of the radiator, the bypass passageway branching from one flow path of the thermostat and being connected to an inlet side of the pump, a branch passageway which branches off from a first intermediate portion of the coolant passageway and merges with the coolant passageway at a second intermediate portion thereof that is downstream of the first intermediate portion, an air-water separating tank arranged at a point along the branch passageway and having a pressure valve which opens to the atmosphere at a prescribed pressure in order to discharge the air to the outside of the closed circulating system, and a volumetric chamber connected upstream of the air-water separating tank for temporarily reducing flow velocity of the coolant.

In another preferred embodiment of the invention, there is provided an engine cooling apparatus in which a closed circulating system is constructed from a radiator arranged in an attitude in which it is tilted toward a front end of the vehicle body, an engine and a coolant passageway, a coolant for cooling the engine is made to circulate in the closed circulating system from upstream to downstream, and air which mixes with the coolant is discharged outside the closed circulating system, the apparatus comprising a pump for circulating the coolant from upstream to downstream, a bypass passageway in which a thermostat having a three-way branching flow path is connected between a discharge side of the engine and an inlet side of the radiator, the bypass passageway branching from one flow path of the thermostat and being connected to an inlet side of the pump, a branch passageway which branches off from a first intermediate portion of the coolant passageway and merges with the coolant passageway at a second intermediate portion thereof that is downstream of the first intermediate portion, an air-water separating tank arranged at a point along the branch passageway and having a pressure valve which opens to the atmosphere at a prescribed pressure in order to discharge the air to the outside of the closed circulating system, a volumetric chamber connected upstream of the air-water separating tank for temporarily reducing flow velocity of the coolant, and an intercooler arranged at a prescribed position in back of the radiator disposed at an incline at the front of a vehicle.

In accordance with the first embodiment of the invention described above, there is a reduction in the amount of coolant which flows into the air-water separating tank connected to the branch passageway that branches off from the coolant passageway. As a result, an adequate air-water separating function is assured even if the air-water separating tank is furnished with a large capacity.

In accordance with the second embodiment of the invention, the coolant which flows through the branch passageway has its flow velocity reduced in the volumetric chamber before it reaches the air-water separating tank, and air bubbles entrapped in the coolant are collected and assume a form in which they are easy to separate. This makes it possible to raise the efficiency of air separation while making the air-water separating tank more compact.

In accordance with the second embodiment of the invention, the wind produced by traveling of the vehicle can be made to strike the core more positively after passing through the radiator, thereby enhancing the cooling effect of the intake air in the intercooler and increases the rigidity of the intercooler.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Several preferred embodiments of the present invention will be described with reference to the drawings.

Figure 1:
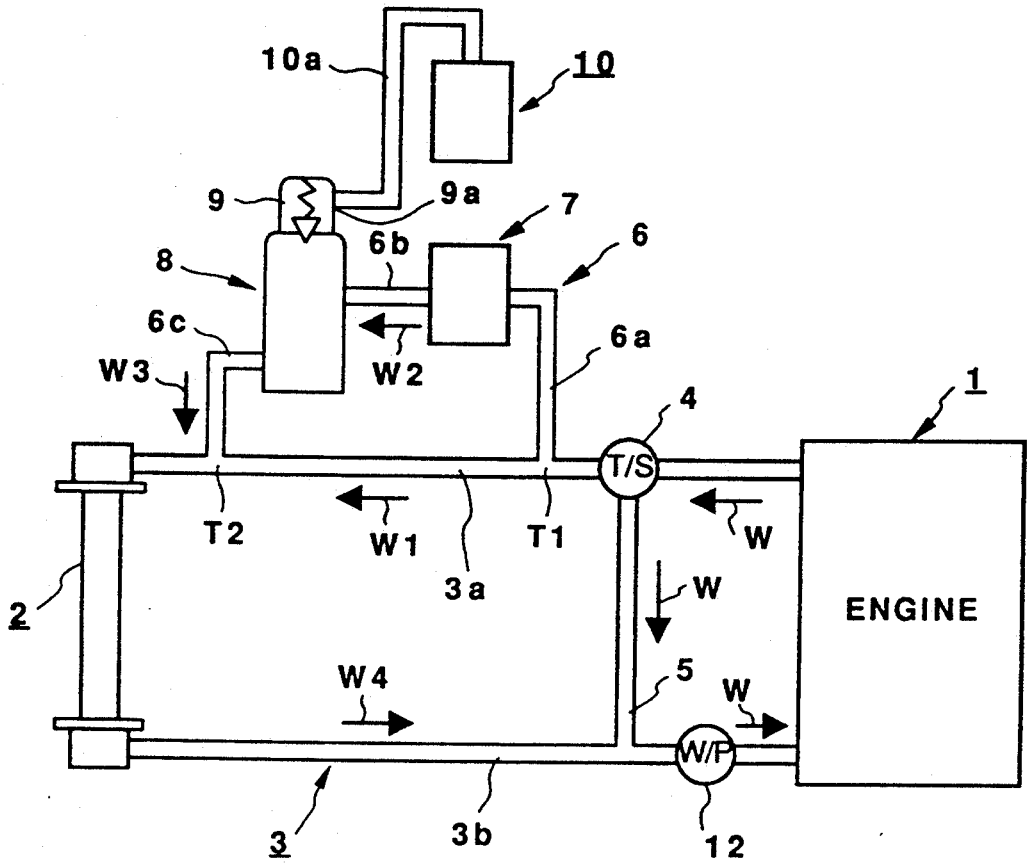
FIG. 1 is a block diagram showing the construction of an engine cooling apparatus according to a first embodiment of the present invention.

FIG. 1 is a block diagram showing the construction of an engine cooling apparatus according to a first embodiment of the present invention and illustrates only the essential components. As shown in FIG. 1, a main cooling-water passageway 3 is connected between an engine 1 and a radiator 2. The main cooling-water passageway 3, which is indicated by the double lines in the drawing, is connected to a water pump 12 and comprises the subpassageways constituting of a cooling-water outgoing line 3*a* from the engine 1 to the radiator 2, and a cooling-water return line 3*b* from the radiator 2 to the engine 1.

A thermostat 4 that is responsive to the water temperature of cooling water W that exits from the engine 1 is provided on the outlet side of the engine 1, which is the inlet side to the cooling-water outgoing line 3*a*. Also provided is a bypass line 5 leading from the thermostat 4 to the cooling-water return line 3*b*. By virtue of this arrangement, the engine cooling water is bypassed through the bypass line 5 and is circulated in the direction of the arrows W by the action of the water pump 12 when the engine 1 is cooled.

A branch passageway 6 is connected to the outgoing line 3*a* of cooling-water passageway 3 between the thermostat 4 and the radiator 2. The branch passageway 6 branches off from the main cooling-water passageway 3 at a branch-off point T1, which is located downstream of the thermostat 4 in the cooling-water outgoing line 3*a* forming a part of the passageway 3, and merges with the main cooling-water passageway 3 at a branch-off point T2. A volumetric chamber 7 for temporarily reducing the flow velocity of the cooling water is connected to a point along the branch passageway 6 via a flow path 6*a*, an air-water separating tank 8 having a pressure valve 9 is connected to the volumetric chamber 7 via a flow path 6*b*, and the air-water separating tank 8 and cooling-water outgoing line 3*a* are connected together at the branch-off point T2 via a flow path 6*c*. More specifically, the volumetric chamber 7 and the air-water separating tank 8 are provided in the order mentioned from the upstream side of the branch passageway 6.

Further, the pressure valve 9 provided on the air-water separating tank 8 has an outlet 9*a* connected via a hose 10*a* to a reservoir tank 10 that is open to the atmosphere.

Figure 2:
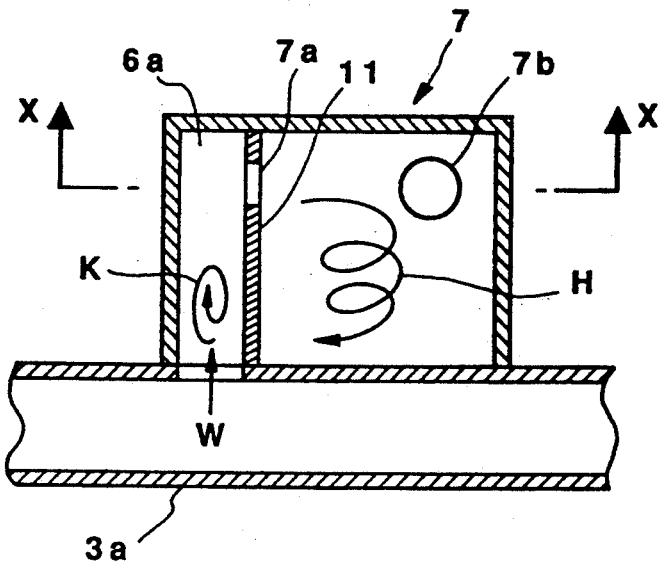
FIG. 2 is a plan view showing a longitudinal cross section of a volumetric chamber.

As shown in FIG. 2, the volumetric tank 7 is provided as an integral part of the cooling-water outgoing line 3*a*. As a result, the arrangement is such that the installation space of the volumetric chamber 7 is reduced. Further, the passageway 6*a* upstream of the volumetric chamber 7 in the branch passageway 6 branches upward from the cooling-water outgoing line 3*a* at a prescribed angle (90° in this embodiment) and defines an upwardly-directed passageway in the integrated structure composed of the volumetric chamber 7 and outgoing line 3*a*. By adopting such an arrangement, the cooling water W which has flowed into the passageway 6*a* on the upstream side of the branch passageway 6 from the cooling-water outgoing line 3*a* rises while swirling in the direction of arrow K in FIG. 2, thus promoting collection and growth of air bubbles mixed in the cooling water W.

Figure 3:
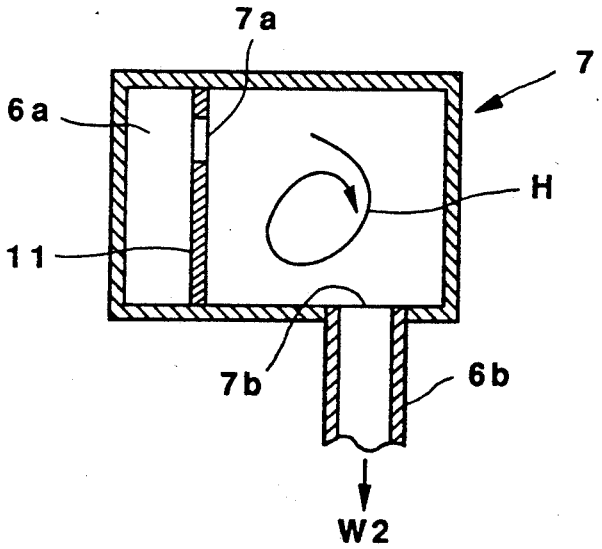
FIG. 3 is a sectional view taken along line X—X of FIG. 3.

The volumetric chamber 7 has an inlet 7*a* formed in the upper part of a partitioning wall 11, which partitions the volumetric chamber 7 from the passageway 6*a* on the upstream side, as illustrated in FIG. 3. The direction of the opening in an inlet 7*a* and the direction of the opening in an outlet 7*b* of the volumetric chamber 7 intersect the horizontal direction at a prescribed angle (90° in this embodiment). By virtue of this arrangement, the cooling water which has flowed into the volumetric chamber 7 is directed toward the outlet 7*b* while swirling in the direction of arrow H, thus promoting collection and growth of air bubbles mixed in the cooling water W. The outlet 7*b* of the volumetric chamber 7 is connected to the air-water separating tank 8 via the flow path 6*b*.

As for the operation of the engine cooling apparatus constructed as set forth above, approximately half of the cooling water which circulates between the engine 1 and the radiator 2 branches off from the cooling-water outgoing line 3*a* so as to flow into the branch passageway 6. However, the cooling water is caused to undergo sufficient swirling in the manner described above before reaching the inlet 7*a* of the volumetric chamber 7, after which its flow velocity is reduced in the volumetric chamber 7, where further swirling motion is imparted. This promotes greatly the collection and growth of the air bubbles mixed in the cooling water. As a result, air bubbles mixed in the cooling water grow to a size that facilitates the separation of the air from the water. Thereafter, the cooling water W which has exited from the volumetric chamber 7 flows into the air-water separating tank 8 via a flow path 6*b* and direction shown by W2. The air separated from the water in the air-water separating tank 8 is discharged into the reservoir 10 via the pressure valve 9 through outlet 9*a* and hose 10*a*. Meanwhile, the cooling water is fed to the radiator 2 after it enters the cooling-water outgoing line 3*a* from the flow path 6*c* at the branch-off point T2.

Accordingly, by virtue of the foregoing construction and operation, the air-water separating function can be sufficiently implemented in an arrangement wherein an air-water separating tank 8 having a pressure valve is provided at a point along a cooling-water passageway. The volumetric chamber 7 functions also as part of the flow path of the cooling-water outgoing line 3*a*, as set forth above, and produces the swirling flow in its interior to make possible the collection and growth of air bubbles. This feature enables the size of the volumetric chamber to be reduced. Furthermore, since the volumetric chamber 7 and the air-water separating tank 8 are provided in a section of branch passageway 6, the degree of freedom in terms of piping is greater than that in the prior art. Thus, a secondary effect of the invention is that the engine cooling apparatus can be installed in the most suitable manner in the narrow confines of the engine room.

Figure 4:
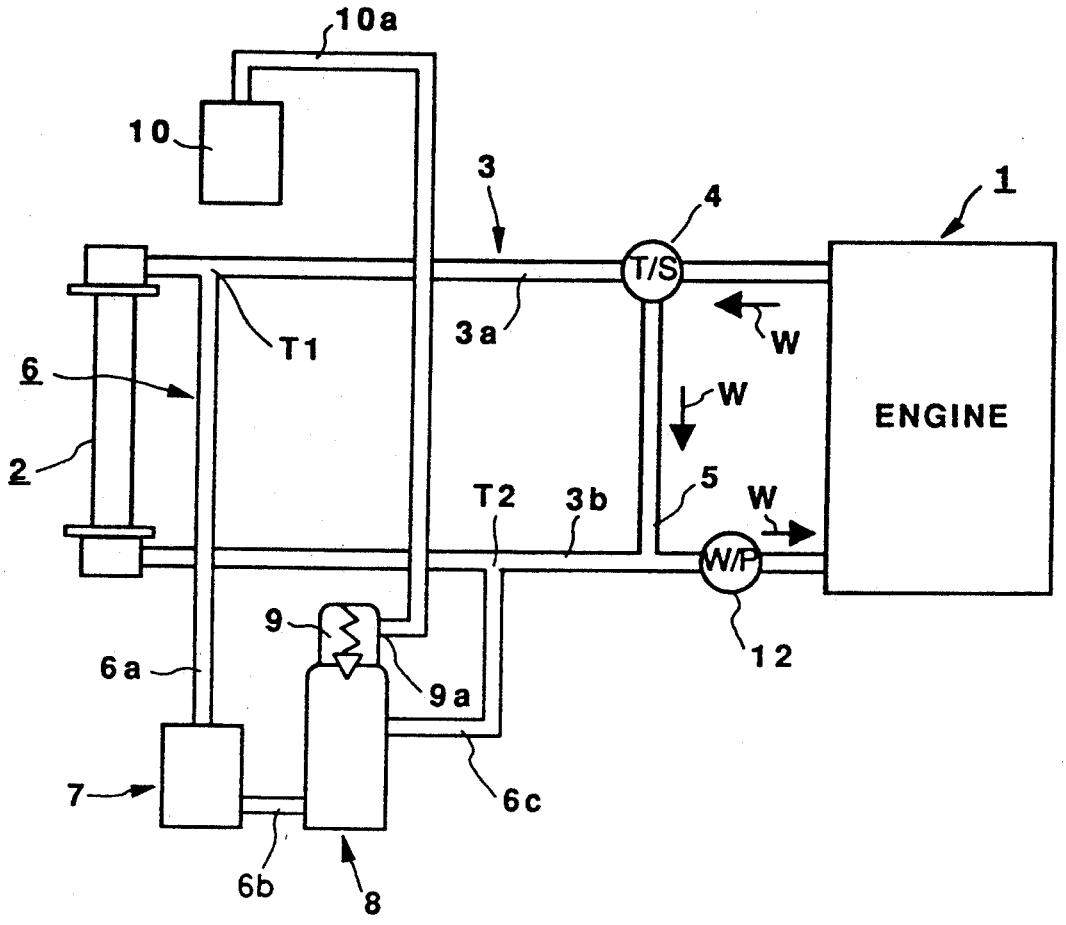
FIG. 4 is a block diagram showing the construction of an engine cooling apparatus according to a second embodiment of the present invention.

FIG. 4 is a block diagram showing the construction of an engine cooling apparatus according to a second embodiment of the present invention; only the essential components are illustrated. In FIG. 4, parts already described based upon FIG. 1 are designated by like reference characters and are not discussed again in order to avoid prolixity; only those parts that are different will be described.

As shown in FIG. 4, the flow path 6*a* branches off from the cooling-water outgoing line 3*a* at the branch-off point T1 in the vicinity of the radiator 2, thereby forming part of the branch passageway 6. The flow path 6*c* is connected to the cooling-water return line 3*b*, which leads to the engine 1, at the branch-off point T2. Thus, the branch passageway 6 is connected in the form of a bypass with respect to the radiator 2. The aforementioned volumetric chamber 7 and the air-water separating tank 8 are connected in the branch passageway 6 from the upstream side thereof in the order mentioned. The reservoir tank 10 is connected to the outlet 9*a* of the pressure valve 9 via the hose 10*a*.

In the above-described arrangement also, the embodiment is capable of functioning in the same manner as the first embodiment. More specifically, effects substantially the same as those of the first embodiment can be obtained even in a case where the branch passageway 6 is connected to bypass the radiator 2. As a result, there is even greater degree of freedom for piping in the engine room. In addition, it suffices for the branch passageway 6 to be connected so as to form a branch with respect to the main cooling-water passageway 3, and it goes without saying that the invention is not limited to the arrangements of the first and second embodiments. Accordingly, the branch passageway 6 need only be connected downstream of the radiator 2.

Figure 5:
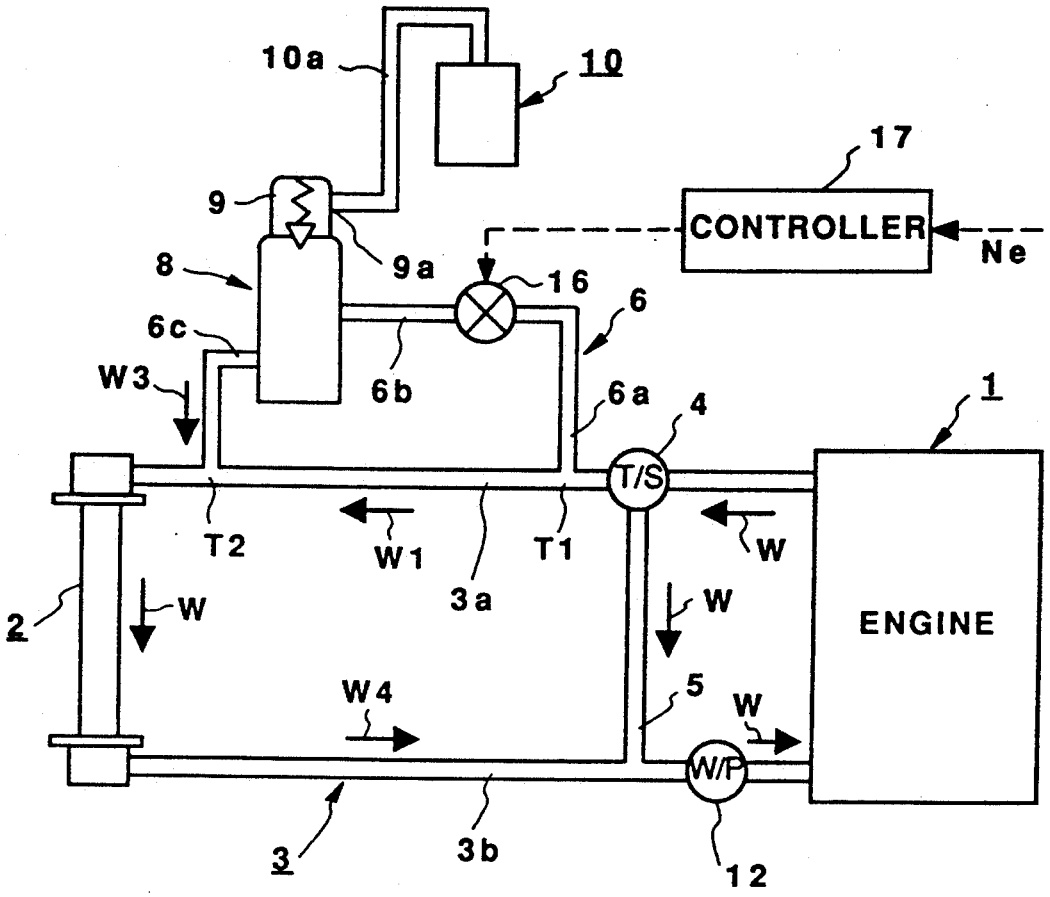
FIG. 5 is a block diagram showing the construction of an engine cooling apparatus according to a third embodiment of the present invention.

FIG. 5 is a block diagram showing the construction of an engine cooling apparatus according to a third embodiment of the present invention; only the essential components are illustrated. In FIG. 5, parts already described based upon FIG. 1 are designated by like reference characters and are not discussed again in order to avoid prolixity; only those parts that are different will be described.

As shown in FIG. 5, the flow path 6*a* connected from the branch-off point T1 of the cooling-water outgoing line 3*a* is provided with a flow control valve 16 the opening degree of which is suitably controlled in dependence upon an increase or decrease in the amount of cooling water which circulates through the cooling-water passageway 3. The flow control valve 16 is so adapted that its opening degree is controlled by a controller 17 to which the number Ne of revolutions of the engine is inputted as information.

Figure 6:
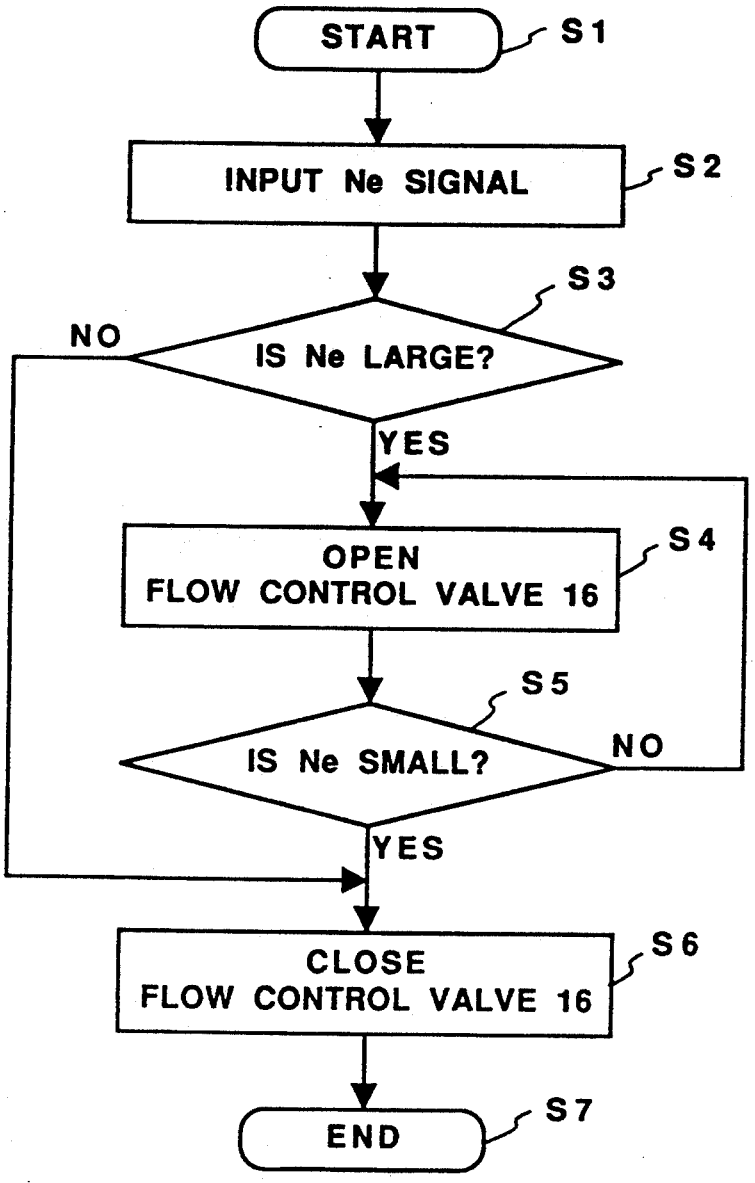
FIG. 6 is a flowchart for describing the operation of the apparatus shown in FIG. 5.

In terms of the operation of this arrangement of the engine cooling apparatus, which will be described with reference to the flowchart of FIG. 6 as well to FIG. 5, operation starts at step S1 as the engine is started up. The program then proceeds to step S2, at which the number Ne of engine revolutions is fed into the controller 17. When the value of Ne becomes greater than a predetermined value at step S3, the flow rate produced by the water pump 12 becomes large, the thermostat 4 is actuated and a large amount of cooling water circulates through the cooling-water passageway 3. The program the proceeds to step S4. Here the opening degree of the flow control valve 16 is enlarged based upon a command from the controller 17. The flow control valve 16 is placed in the open state.

As a result, the amount of cooling water which flows into the air-water separating tank 8 increases, and the amount of decline in the air-water separating function which accompanies the increase in the flow rate of the cooling water in the entire engine cooling apparatus is capable of being compensated for sufficiently by the inflow to the air-water separating tank 8. As a result, the amount of air separation is increased. Next, at step S5, when it is determined that the number Ne of engine revolutions has declined and the amount of circulating cooling water has diminished, the opening of the flow control valve 16 is reduced or the valve is closed by a command from the controller 17 at step S6, thereby diminishing the amount of cooling water that flows into the air-water separating tank 8.

If it is determined at step S3 that the number N of engine revolutions is small, the program proceeds to step S6, where the opening of the flow control valve 16 is reduced or the valve is closed by the command from the controller 17, thereby diminishing the amount of cooling water that flows into the air-water separating tank 8.

As a result of control performed in the above-mentioned manner, the air-water separating function is capable of being increased or decreased in approximate proportion to the amount of cooling water being circulated. Accordingly, a very efficient air-water separating operation can be carried out. It should be noted that control can be performed in the same manner even if the temperature of the cooling water is used instead of the number of engine revolutions as the information applied to the controller 17.

Figure 7:
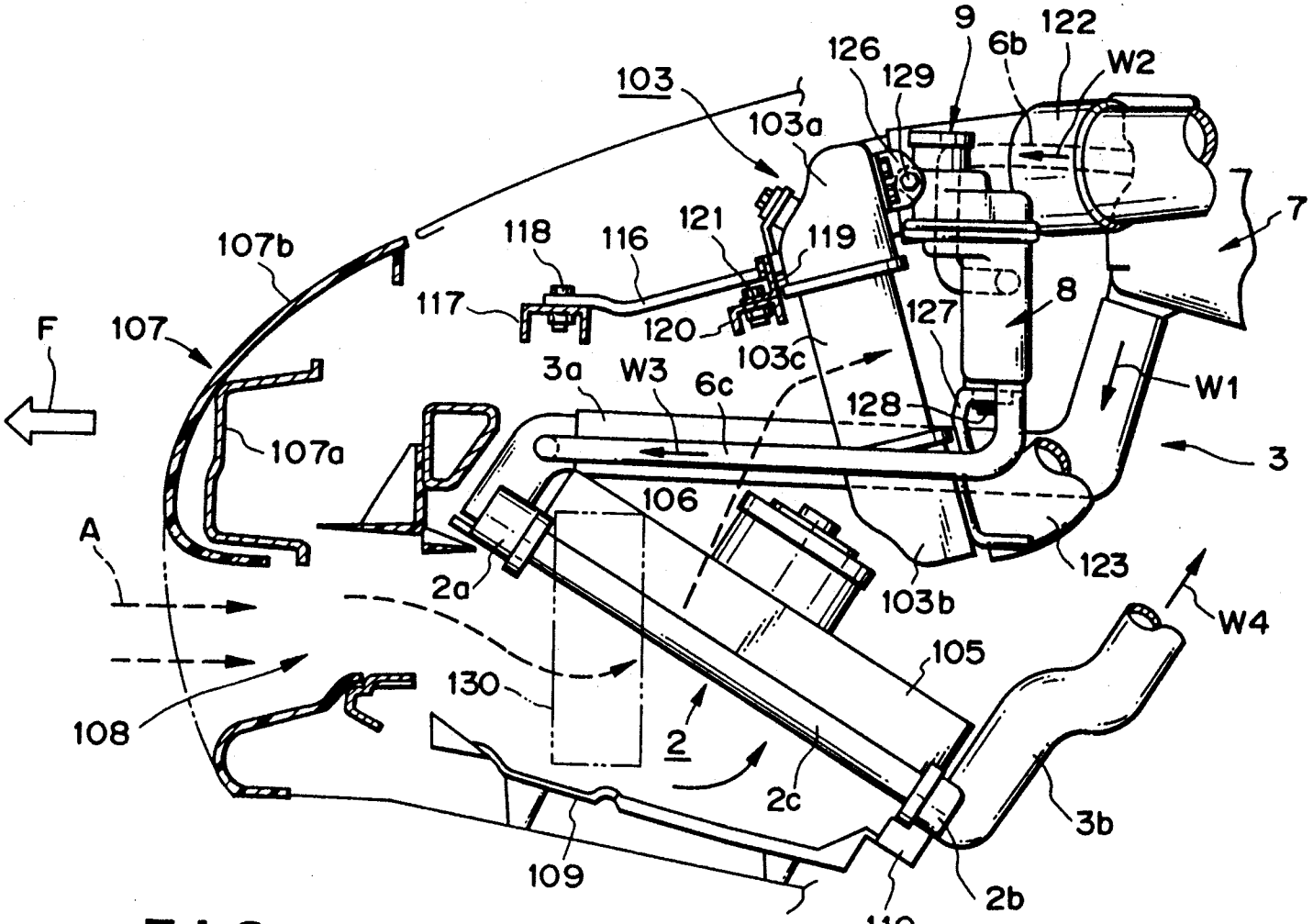
FIG. 7 is a layout view showing the construction of an engine cooling apparatus according to a fourth embodiment of the present invention.
Figure 8:
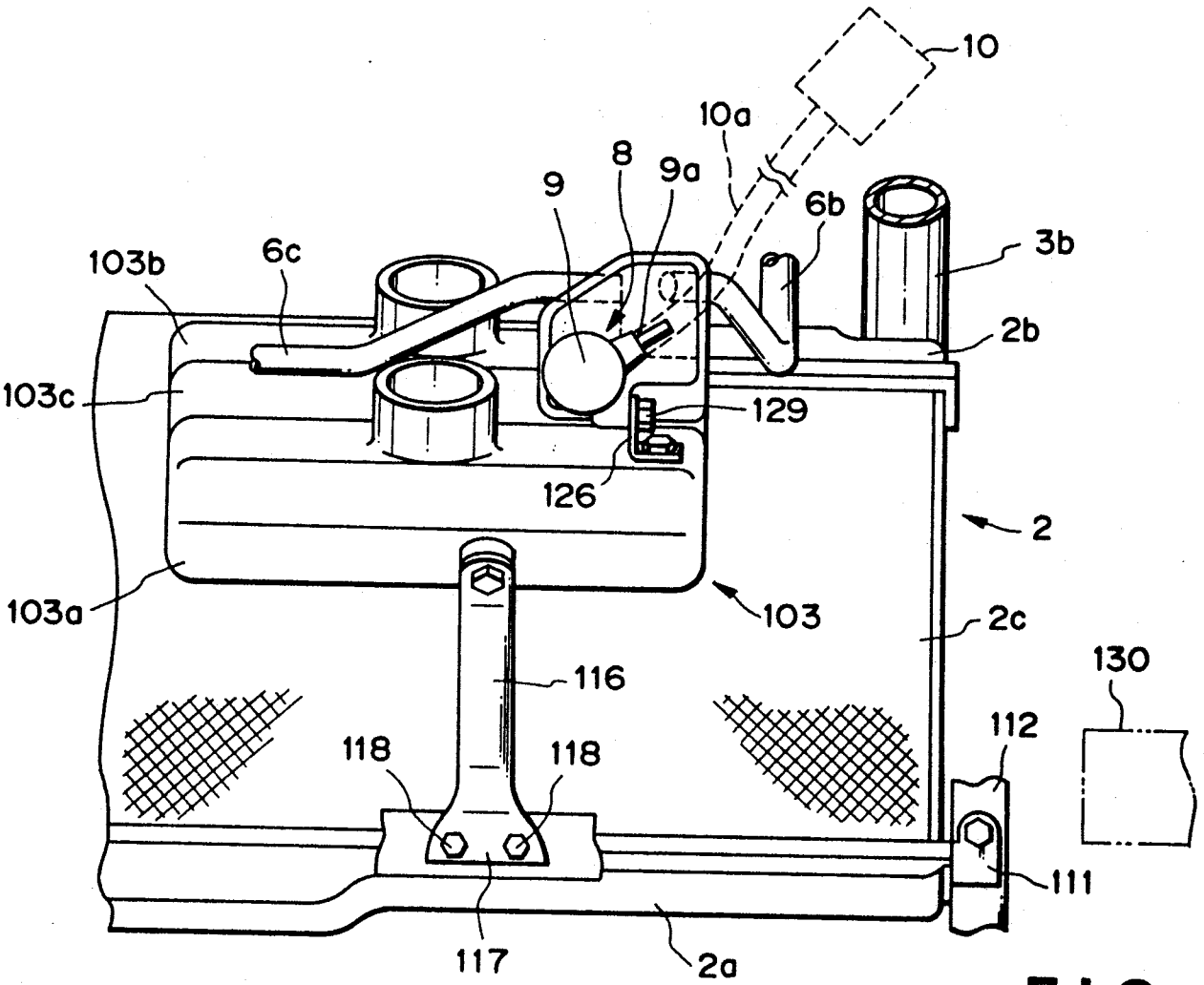
FIG. 8 is a plan view showing part of the arrangement of FIG. 7.

FIG. 7 is a side view according to a fourth embodiment of the invention and shows the manner in which the apparatus is arranged with respect to the forward direction F of the vehicle. FIG. 8 is a plan view showing the principal portion of FIG. 7. In FIGS. 7 and 8, parts already described based upon FIG. 1 are designated by like reference characters and are not discussed again in order to avoid prolixity; only those parts that are different will be described.

As shown in FIGS. 7 and 8, a radiator 2, an intercooler 103 and an air-water separating tank 8 are disposed in the engine room at a position forward of the engine, which is not shown.

The structure of the radiator 2 is such that an upper tank 2*a* and a lower tank 2*b* are connected by a core 2*c* constituting a heat exchanger. An electric fan (not shown) enclosed by a cowling 105 is attached to the back of the core 2*c*, and the fan is rotated by a motor 106. An air intake port 108 is opened in the lower portion of a bumper 107 comprising a bumper reinforcement 107*a* and a shell member 107*b*. The radiator 2 is installed in a forwardly tilted attitude in the interior of a radiator duct 109 communicating with the air intake port 108.

The radiator 2 is secured in the forwardly tilted state by connecting the lower tank 2*b* to a support member 110 and connecting a bracket 111, which is attached to both sides of the upper tank 2*a*, to a support member 112. The engine is provided with the above-mentioned volumetric chamber 7. The cooling water within a water jacket of the engine is introduced from the volumetric chamber 7 to the upper tank 2*a* of the radiator 2 via the cooling-water passageway 3. The cooling water passes through the core 2*c* of the radiator 2 and returns to the volumetric chamber 7 via the cooling-water return line 3*b* by flowing in the direction of arrow W4. The cooling water is fed into the aforementioned water jacket.

The intercooler 103, which comprises an upper tank 103*a*, a lower tank 103*b* and a core 103*c* connecting the upper and lower tanks, is disposed above the radiator 2 mounted in the forwardly tilted attitude mentioned above. By thus arranging the radiator 2 and the intercooler 3, wind produced by traveling of the vehicle, as indicated by the arrows A, passes through the radiator 2 and then blows against the core 103*c* of the intercooler 103. The intercooler 103 is secured in this attitude by connecting a support arm 116 attached to the upper tank 103*c* to a first cross member 117 by a nut-and bolt arrangement 118, and joining connecting pieces 119, 119 attached to principal portions of the upper tank 103*a* and lower tank 103*b* to respective support members 120, 120 by nut-and-bolt arrangements 121, 121.

In the intercooler 103, the intake air which has passed through a turbosupercharger (not shown) from an air cleaner is fed into the upper tank 103*a* by a pipe 122. After being cooled by passing through the core 103*c*, the intake air is supplied from the lower tank 103*b* to the combustion chamber of the engine via a pipe 123.

Furthermore, the air-water separating tank 8 is provided in back of the intercooler 103 and is offset to one side where it will not interfere with passage of the wind through the core 103*c* of the intercooler 103. The air-water separating tank 8 is provided with an internal space in which the cooling water of the engine is temporarily collected. The cooling water, which is introduced to the tank 8 from the volumetric chamber 7 via the flow path 6*b* constituting the branch passageway 6, is collected within the tank 8, where the air is separated from the water and the separated air is vented to the exterior of the tank. The cooling water following separation of the air is made to flow into the upper tank 2*a* of the radiator 2 via the flow path 6*c*, whereby the cooling water joins the rest of the cooling water and returns to the volumetric chamber 7.

An upper bracket 126 is attached to the back side of the upper tank 103*a* of the intercooler 103, and a lower bracket 127 having a longitudinal hole is attached to the back side of the lower tank 103*b*. A pin 128 provided on the bottom of the air-water separating tank 8 is fitted into the longitudinal hole of the lower bracket 127, in which state a bolt 129 is passed through the upper bracket 126 and screwed tightly in a threaded hole provided in the air-water separating tank 8, whereby the air-water separating tank 8 is attached to the intercooler 103 in a form connecting the upper tank 103*a* and the lower tank 103*b*.

In the structure described above, the wind which blows in from the air intake port 108 at the front of the vehicle body as the automobile travels passes through the core 2*c* of the radiator 2, whereby the cooling water which flows through the core 2*c* is cooled by heat exchange. Next, the wind blows against the intercooler 103 disposed above the radiator 2 so that the intake air which flows through the core 103*c* of the intercooler 103 is cooled by heat exchange.

Accordingly, the wind which blows in and passes through the radiator 2 strikes the intercooler 103 to enhance the cooling of the intake air. Furthermore, since the air-water separating tank 8 is attached to the back side of the intercooler 103 in a state connecting the upper tank 103*a* and lower tank 103*b*, the intercooler 103 is furnished with greater rigidity, as a result of which vibration of the core 103*c* is suppressed even though the wind produced by the traveling vehicle blows directly against the core.

When this structure in which the air blows strongly against the intercooler 103 is adopted, it may appear that the cooling effect of the wind produced by the traveling vehicle will be too strong when the engine is running under a low load, as a result of which the intake air which passes through the interior of the intercooler 103 might be cooled excessively. However, since the air-water separating tank 8 through which the comparatively high-temperature engine cooling water flows is arranged in close proximity to the intercooler 103, the aforesaid excessive cooling is prevented by the heat from the cooling water given off from the air-water separating tank 8.

When the engine is running under a high load, the temperature of the cooling water rises. However, since the wind which blows through the intercooler 103 as the vehicle travels strikes against the air-water separating tank 8 as well, the cooling of the water is promoted by the tank, thereby supplementing the cooling effect by the radiator 2.

Figure 9:
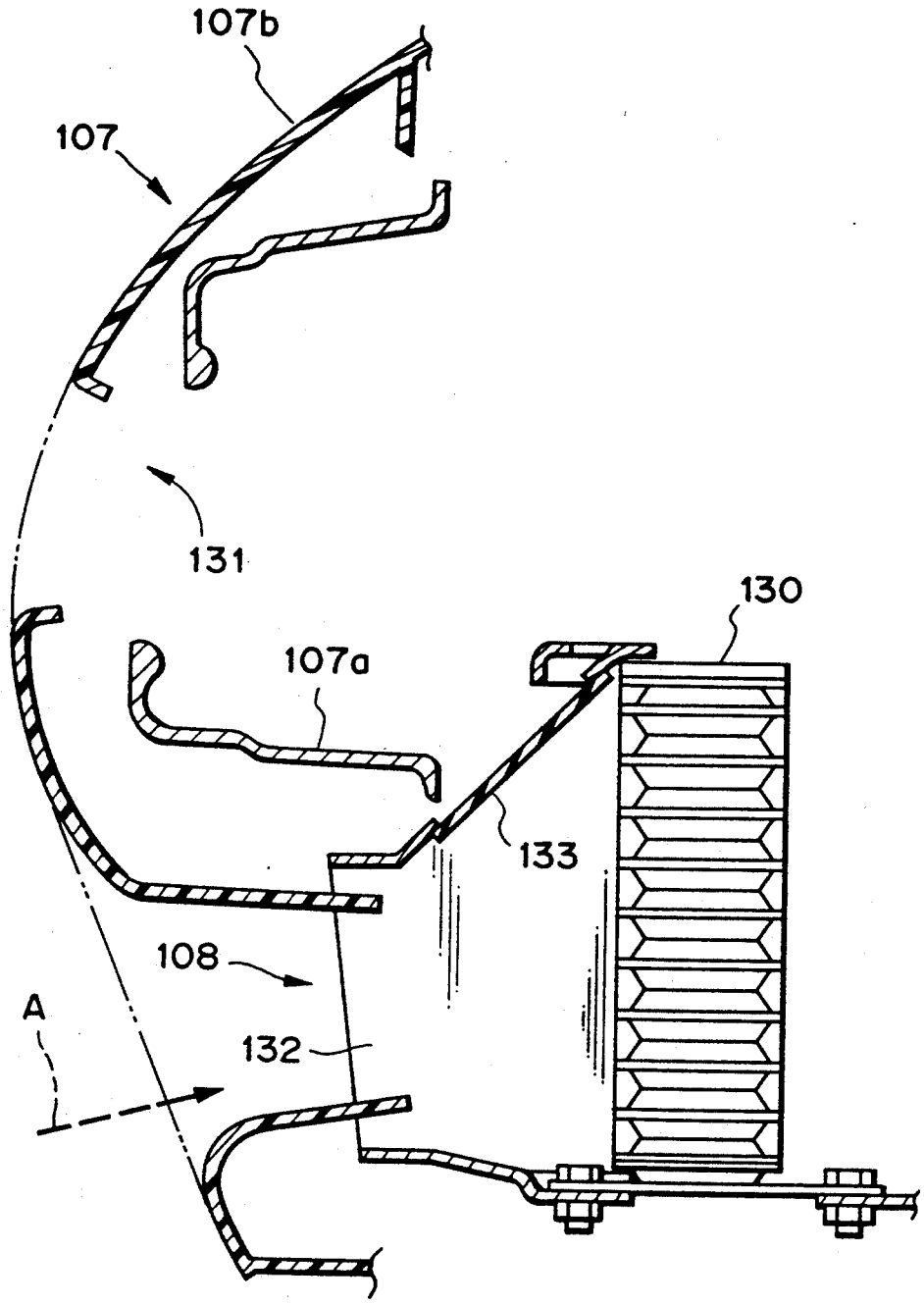
FIG. 9 is a side view showing part of the arrangement of FIG. 7.

In high-performance automobiles, there are cases in which an oil cooler 130 is provided alongside the radiator 2 at a position immediately to the rear of a light mounting hole 131 formed in a bumper 107 shown in FIG. 9. In such an arrangement, a duct 132 is provided at the interior of the air intake port 108 in such a manner that the wind produced by the traveling vehicle will blow against the oil cooler 130. With this arrangement, however, the bumper reinforcement 107*a* is situated in close proximity to the duct 132. Consequently, when the automobile sustains a collision at the front end of the vehicle body, there is the danger that the bumper reinforcement 107*a* will break through the duct 132 and impact directly against the oil cooler 130, thereby damaging it. Accordingly, in this embodiment, the portion of the duct 132 that might be struck by the bumper reinforcement 107*a* is made of a resilient sheet 133 suitably mounted such as by an adhesive. Even if the bumper reinforcement 107*a* should strike the duct 132, therefore, the bumper reinforcement 107*a* can be prevented from directly impacting upon the oil cooler 130 by means of the resilient sheet 133.

In the above-described structure in which the radiator 2 is mounted in the forwardly tilted state and the space formed above the radiator 2 is utilized to install the intercooler and other equipment, there is the danger that parts such as the mounting nuts and bolts will drop upon and damage the radiator when the equipment is mounted above the radiator 2 on an automobile assembly line.

Figure 10:
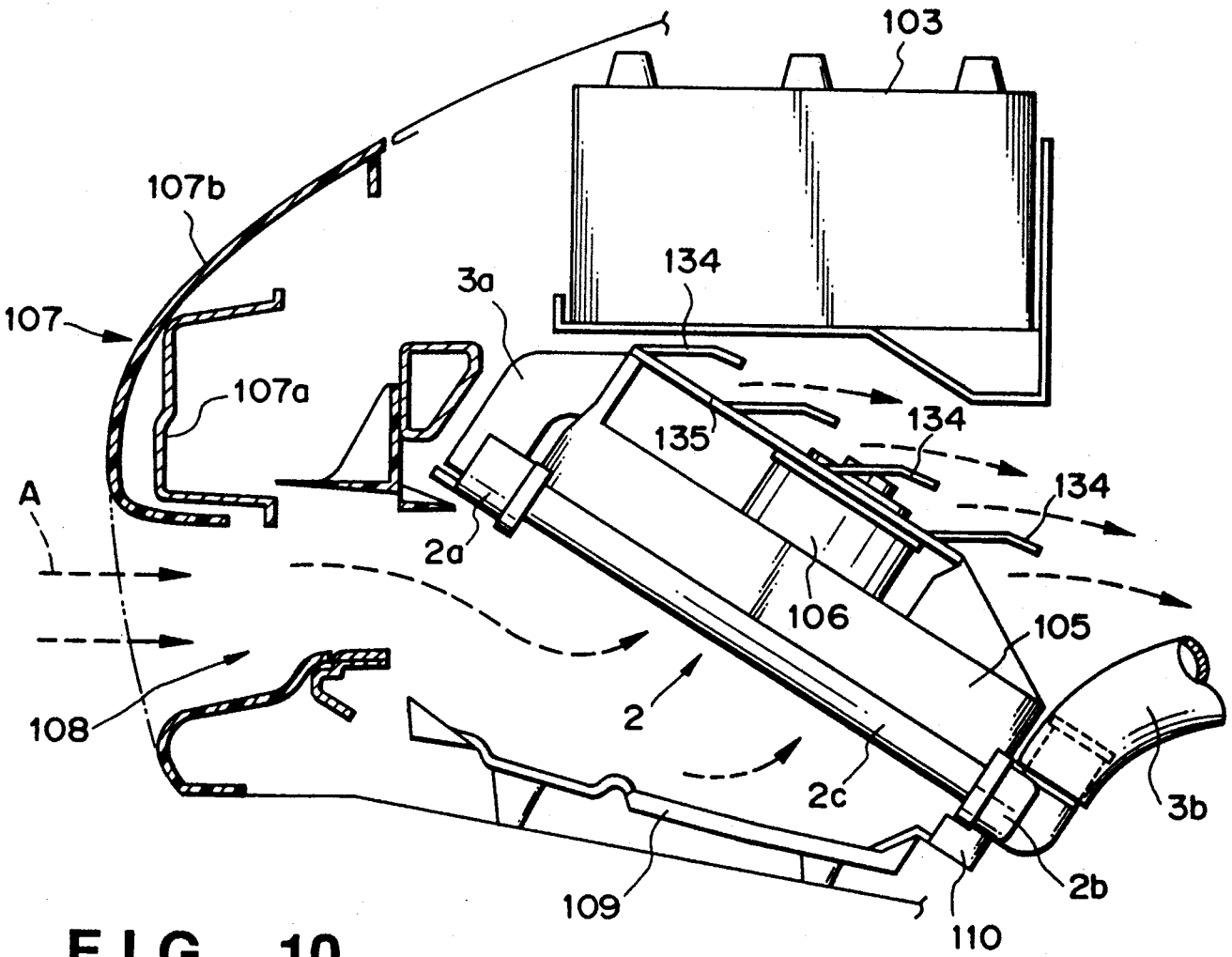
FIG. 10 is a layout view showing the construction of an engine cooling apparatus according to a fifth embodiment of the present invention.

Accordingly, as illustrated in the fifth embodiment shown in FIG. 10, a number of fairing plates 134~134 are attached to the exhaust side of the radiator 2 by a support member 135, and the fairing plates 134~134 are shaped to extend obliquely up and away from the radiator 2 so that the wind will be force to flow toward the posterior of the radiator. This solves the aforementioned problem, since the structure as seen from above is such that the radiator 2 is covered by the fairing plates 134~134; therefore, any falling parts will strike the fairing plates 134~134 and then bounce away. This prevents the parts from falling directly into the radiator 2. Of the wind which has passed through the radiator 2, that part whose direction is changed by the fairing plates 134~134 is fed toward the rearwardly located engine without coming into contact with the intercooler 103. As a result, the wind which has not undergone a heat exchange with the intercooler 103 blows against the engine and promotes its cooling in excellent fashion.

Thus, as described above, the air-water separating tank is mounted so as to connect the upper tank and lower tank of the intercooler. The air-water separating tank therefore performs an additional function, namely the reinforcement of the intercooler, to compensate for any lack in the rigidity of the intercooler. Accordingly, even if the wind produced by the traveling vehicle blows strongly against the intercooler, vibration of its core can be suppressed and the cooling effect of the wind upon intake air can be enhanced. Furthermore, the cooling water which flows through the intercooler and the air-water separating tank acts upon the intercooler so that excessive cooling of the intake air can be prevented. When the engine is running under a high load, the wind which has passed through the intercooler strikes the air-water separating tank, and therefore the cooling of the water is promoted by this wind.

Further, since the radiator is tilted forward and the space above it is utilized to install the intercooler, the wind which has passed through the radiator strikes the core of the intercooler in positive fashion, thereby enhancing the cooling of the intake air in the intercooler.

The present invention is not limited to the above embodiments and various changes and modifications can be made within the spirit and scope of the present invention. Therefore, to apprise the public of the scope of the present invention the following claims are made.

What is claimed is:

1. An apparatus for cooling an engine of an automotive vehicle, in which a closed circulating system is constructed from an engine, a radiator and a coolant passageway connecting the engine and radiator, wherein a coolant for cooling the engine is made to circulate in the closed circulating system from upstream to downstream, and air which mixes with the coolant is discharged to the outside of the closed circulating system, said apparatus comprising:

a pump, connected to the coolant passageway, for circulating the coolant from upstream to downstream;

a thermostat having flow paths which branch in three directions connected between a discharge side of said engine and an inlet side of said radiator;

a bypass passageway branching off from one flow path of said thermostat and being connected to an inlet side of said pump;

a branch passageway which branches off from a first intermediate portion of the coolant passageway and merges with said coolant passageway at a second intermediate portion thereof that is downstream of said first intermediate portion;

an air-water separating tank arranged at a point along said branch passageway and having a pressure valve which opens to the atmosphere at a prescribed pressure in order to discharge the air to the outside of said closed circulating system; and a volumetric chamber connected upstream of said air-water separating tank for temporarily reducing flow velocity of the coolant, wherein said volumetric chamber is provided as an integral part of said coolant passageway, a part of said branch passageway that is upstream of said volumetric chamber is formed by an upwardly directed passageway that branches upward from said coolant passageway at a prescribed angle and communicates with an inlet port formed in an upper portion of said volumetric chamber, and an opening in the inlet port of said volumetric chamber and an opening in an outlet port of said volumetric chamber are aligned to establish a predetermined flow path of the cooling water from the inlet port to the outlet port.

2. An apparatus for cooling an engine of an automotive vehicle, in which a closed circulating system is constructed from an engine, a radiator and a coolant passageway connecting the engine and radiator, wherein a coolant for cooling the engine is made to circulate in the closed circulating system from upstream to downstream, and air which mixes with the coolant is discharged to the outside of the closed circulating system, said apparatus comprising:

a pump, connected to the coolant passageway, for circulating the coolant from upstream to downstream;

a thermostat having flow paths which branch in three directions connected between a discharge side of said engine and an inlet side of said radiator;

a bypass passageway branching off from one flow path of said thermostat and being connected to an inlet side of said pump;

a branch passageway which branches off from a first intermediate portion of the coolant passageway and merges with said coolant passageway at a second intermediate portion thereof that is downstream of said first intermediate portion;

an air-water separating tank arranged at a point along said branch passageway and having a pressure valve which opens to the atmosphere at a prescribed pressure in order to discharge the air to the outside of said closed circulating system; and switching valve means, connected upstream of said air-water separating tank, for regulating the amount of coolant in dependence upon the operating state of said engine.

3. The apparatus according to claim 2 wherein the operating state of the engine is number of revolutions of said engine.

4. The apparatus according to claim 2 wherein the operating state of the engine is temperature of the coolant.

5. An apparatus for cooling an engine of an automotive vehicle, in which a closed circulating system is constructed from a radiator arranged in an attitude in which it is tilted toward a front end of the vehicle body, an engine, and a coolant passageway connecting the engine and radiator, wherein a coolant for cooling the engine is made to circulate in the closed circulating system from upstream to downstream, and air which mixes with the coolant is discharged to the outside of the closed circulating system, said apparatus comprising:

a pump, connected to the coolant passageway, for circulating the coolant from upstream to downstream;

a thermostat having flow paths which branch in three directions connected between a discharge side of said engine and an inlet side of said radiator;

a bypass passageway branching off from one flow path of said thermostat and being connected to an inlet side of said pump;

a branch passageway which branches off from a first intermediate portion of the coolant passageway and merges with said coolant passageway at a second intermediate portion thereof that is downstream of said first intermediate portion;

an air-water separating tank arranged at a point along said branch passageway and having a pressure valve which opens to the atmosphere at a prescribed pressure in order to discharge the air to the outside of said closed circulating system;

a volumetric chamber connected upstream of said air-water separating tank for temporarily reducing flow velocity of the coolant; and an intercooler having an upper tank and a lower tank, and arranged at a prescribed position in back of said radiator, wherein said air-water separating tank is mounted to interconnect said upper tank and said lower tank in back of said inter-cooler.

6. The apparatus according to claim 5, further comprising plate members for changing the direction of wind, which is produced by traveling of the vehicle, in back of said radiator, and preventing parts from falling onto the back side of said radiator.

7. The apparatus according to claim 5, wherein said volumetric chamber is provided as an integral part of said coolant passageway, a part of said branch passageway that is upstream of said volumetric chamber is formed by an upwardly directed passageway that branches upward from said coolant passageway at a prescribed angle and communicates with an inlet port formed in an upper portion of said volumetric chamber, and an opening in the inlet port of said volumetric chamber and an opening in an outlet port of said volumetric chamber are aligned to establish a predetermined flow path of the cooling water from the inlet port to the outlet port.

8. An apparatus for cooling an engine of an automotive vehicle, in which a closed circulating system is constructed from an engine, a radiator and a coolant passageway connecting the engine and radiator, wherein a coolant for cooling the engine is made to circulate in the closed circulating system from upstream to downstream, and air which mixes with the coolant is discharged to the outside of the closed circulating system, said apparatus comprising:

a pump, connected to the coolant passageway, for circulating the coolant from upstream to downstream;

a branch passageway which branches off from a first intermediate portion of the coolant passageway and merges with said coolant passageway at a second intermediate portion thereof that is downstream of said first intermediate portion;

an air-water separating tank arranged at a point along said branch passageway and having a pressure valve which opens to the atmosphere at a prescribed pressure in order to discharge the air to the outside of said closed circulating system; and a volumetric chamber connected upstream of said air-water separating tank for temporarily reducing flow velocity of the coolant, wherein said volumetric chamber is provided as an integral part of said coolant passageway, a part of said branch passageway that is upstream of said volumetric chamber is formed by an upwardly directed passageway that branches upward from said coolant passageway at a prescribed angle and communicates with an inlet port formed in an upper portion of said volumetric chamber, and an opening in the inlet port of said volumetric chamber and an opening in an outlet port of said volumetric chamber are aligned to establish a predetermined flow path of the cooling water from the inlet port to the outlet port.

9. An apparatus for cooling an engine of an automotive vehicle, in which a closed circulating system is constructed from an engine, a radiator and a coolant passageway connecting the engine and radiator, wherein a coolant for cooling the engine is made to circulate in the closed circulating system from upstream to downstream, and air which mixes with the coolant is discharged to the outside of the closed circulating system, said apparatus comprising:

a pump, connected to the coolant passageway, for circulating the coolant from upstream to downstream;

a branch passageway which branches off from a first intermediate portion of the coolant passageway and merges with said coolant passageway at a second intermediate portion thereof that is downstream of said first intermediate portion;

an air-water separating tank arranged at a point along said branch passageway and having a pressure valve which opens to the atmosphere at a prescribed pressure in order to discharge the air to the outside of said closed circulating system; and switching valve means, connected upstream of said air-water separating tank, for regulating the amount of coolant in dependence upon the operating state of said engine.

10. An apparatus for cooling an engine of an automotive vehicle, in which a closed circulating system is constructed from a radiator arranged in an attitude in which it is tilted toward a front end of the vehicle body, an engine, and a coolant passageway connecting the engine and radiator, wherein a coolant for cooling the engine is made to circulate in the closed circulating system from upstream to downstream, and air which mixes with the coolant is discharged to the outside of the closed circulating system, said apparatus comprising:

a pump, connected to the coolant passageway, for circulating the coolant from upstream to downstream;

a branch passageway which branches off from a first intermediate portion of the coolant passageway and merges with said coolant passageway at a second intermediate portion thereof that is downstream of said first intermediate portion;

an air-water separating tank arranged at a point along said branch passageway and having a pressure valve which opens to the atmosphere at a prescribed pressure in order to discharge the air to the outside of said closed circulating system;

a volumetric chamber connected upstream of said air-water separating tank for temporarily reducing flow velocity of the coolant; and an intercooler having an upper tank and a lower tank, and arranged at a prescribed position in back of said radiator, wherein said air-water separating tank is mounted to interconnect said upper tank and said lower tank in back of said inter-cooler.

* * * * *